United States Patent [19]

Itoh

[11] Patent Number: 4,773,648

[45] Date of Patent: Sep. 27, 1988

[54] SLOT MACHINE

[75] Inventor: Yoshie Itoh, Tokyo, Japan

[73] Assignee: Warner Shokai Inc., Tokyo, Japan

[21] Appl. No.: 765,247

[22] Filed: Aug. 13, 1985

[30] Foreign Application Priority Data

Nov. 19, 1984 [JP] Japan ..... 59-242338
Feb. 27, 1985 [JP] Japan ..... 60-36489

[51] Int. Cl.[4] ..... A63F 5/04

[52] U.S. Cl. ..... 273/143 R; 194/338; 194/344; 221/277; 453/35

[58] Field of Search ..... 273/143 R; 194/334, 194/336, 344, 347; 221/265, 277; 133/3 R, 3 C, 3 D, 5 R; 453/33-35, 49, 57

[56] References Cited

U.S. PATENT DOCUMENTS

| | | | |
|---|---|---|---|
| 483,939 | 10/1892 | McDade | 194/334 X |
| 932,403 | 8/1909 | Long | 194/338 |
| 2,103,744 | 12/1937 | Dumble | 133/5 R X |
| 2,812,182 | 11/1957 | Fiorino | 273/143 R |
| 2,941,536 | 6/1960 | Doubleday | 133/5 R |
| 3,464,693 | 9/1969 | Bailey | 273/143 R X |
| 4,155,437 | 5/1979 | Tojza et al. | 194/338 |
| 4,238,127 | 12/1980 | Lucero et al. | 273/143 R |
| 4,240,536 | 12/1980 | Noell, Jr. | 194/334 |
| 4,273,333 | 6/1981 | Nicolaus | 273/143 R |

FOREIGN PATENT DOCUMENTS

| | | | |
|---|---|---|---|
| 1584926 | 2/1981 | United Kingdom | 273/143 R |

*Primary Examiner*—Paul E. Shapiro
*Attorney, Agent, or Firm*—Holman & Stern

[57] ABSTRACT

A slot machine of the type having a number of drums, an actuating lever, a kicker, a drum rotating mechanism, detecting mechanism for detecting any hit mode and a coin discharging mechanism. An actuating frame and a kicker engaging with the hook of the actuating lever are formed as different bodies. When the kick projections of the kicker hit the ridge of an index notched disk provided on the drum, it is allowed to escape in the reverse direction at once. The kicker is adapted for energizing operation when each kick projection enters a notch of a corresponding notched disk, whereby the kick projections are protected from excessive loading. Moreover, when the rotary drums are stopped, the hit mode according to the permutations displayed on the rotary drums is automatically detected. The operation of the detecting means controls the mechanical sequence through operation of the coin discharge control mechanism and the discharge of coins depending on the hit mode because the angle of rotation of the coin discharge mechanism is controlled.

16 Claims, 11 Drawing Sheets

SLOT MACHINE

BACKGROUND OF THE INVENTION

This invention relates to a slot machine and more particularly to a mechanical slot machine designed to discharge a predetermined number of coins according to the combinations of pictorial symbols arranged on drums which are rotated and stopped in sequence.

Drum type slot machines so designed as to discharge coins according to permutations or combinations of pictures, symbols and the like arranged on a plurality of drums are roughly classified into electrically- and mechanically-driven ones according to drum driving methods. Electrically-driven slot machines generally require a large complicated mechanism and are expensive because coins are discharged after the combinations of pictures displayed on the drums rotated by a motor and stopped using electromagnetic brakes are electrically detected. On the contrary, mechanically-driven slot machines are not only small and simple in construction but also inexpensive because mechanical energy such as the force of springs is utilized to rotate and stop each drum, detect the combinations of pictures displayed thereon and discharge coins without using motors and electromagnets. However, those mechanical slot machines have been either complicated in mechanism and not easy to operate or, on the contrary, too simple in construction to perform such function as makes the game exciting. For instance, some of the former have had special stop buttons, one of each drum, to stop drums rotated by means of an actuating lever; however, the disadvantage is that they require several manual operations from actuating the drums up to stopping them, thus making games complicated. On the other hand, some of the latter have been designed to stop the drums automatically by a stopper incorporated therein, not by stop buttons. The slot machines of this kind have had a disadvantage in that the arrangement of pictures, symbols, etc., on the drums, when stopped, is liable to show a certain pattern or tendency and therefore the fairness of the game is not ensured, because a plurality of drums are simultaneously stopped in a relatively short time but cannot be stopped one by one at intervals.

The present inventor has proposed in U.S. Pat. No. 4,261,571 to provide a mechanical slot machine capable, by a single operation of pulling an actuating lever, of automatically performing a series of actions including rotating drums, stopping them in regular sequence after the lapse of a certain period of time, detecting their stop positions and discharging coins according to the stop positions; however, the problems is that such a slot machine is still lacking in versatility because coins are discharged only when pictures, symbols and the like on each drum, when stopped, are displayed according to a predetermined permutation, that is, only one hitting mode is satisfied. For that reason, the present inventor has further provided a slot machine in U.S. Pat. No. 4,504,058 including supplying rotary drums with a plurality of coin magazines, incorporating projections with each other to arrange a plurality of hit modes, the projections being used to detect the stop position of each drum, and allowing the coin magazines to open individually or simultaneously depending on the hit mode.

According to U.S. Pat. No. 4,261,571, projections are inserted in the notches of index notched disks on the drum sides while the supporting frame is turned by the operation of an actuating lever and a kicker is directly returned to its original position when a hook at the end of the lever pull is released to start the rotation of the drums. However, the problem is that, if the drum is started while the projection is mounted on the index notched disk, the drum will be forced up because of an excessive load and this subjects the drum shaft to an unbalanced load, or if it is not pushed up, the kicker will deform, thus making the starting impossible. In U.S. Pat. No. 4,504,058, because it is so arranged that the shutter on the bottom of a coin magazine is forced to open and shut by transferring the motion of the projections to latches, such a slot machine requires not only a complicated mechanism but also delicate adjustment which tends to easily bring about mechanical failure.

SUMMARY OF THE INVENTION

An object of the present invention is to provide a slot machine whose kicker is prevented from being damaged to ensure that the drums are smoothly actuated and rotated.

Another object of the present invention is to provide a slot machine capable of offering a plurality of hit modes depending on the stop position of each drum.

Still another object of the present invention is to provide a mechanical slot machine capable of discharging the predetermined number of coins according to the hit mode involved.

A further object of the present invention is to provide a mechanical slot machine allowing the discharge and recovery of either the whole or a part of the coins stored in a coin bank.

The mechanical slot machine according to the present invention comprises a plurality of drums rotatably supported within a frame and equipped with index notched disks; a drum rotating mechanism for simultaneously rotating the drums by driving a kicker and releasing it after it has been completely pulled forward by an actuating lever; a slow return mechanism for successively stopping each of the drums after they have been actuated to rotate; detecting means for detecting hit modes according to the permutations of the stop positions of the drum; a coin bank for storing the slotted coins in a piled-up state; a coin discharge control mechanism for determining the number of coins to be discharged according to the operation of the detecting means; and a coin discharging mechanism for successively discharging the number of coins piled up and determined by the coin discharge control mechanism on a first-in-first-out basis.

The kicker according to the present invention is attached to a body different from the actuating frame which outwardly engages with the hook driven by the lever pull, and the kicker is allowed to enter in the notches of the index notched disks when it follows the tilted movement of the actuating frame and turns in the same direction thereof, whereby when the kicker projection comes in contact with the ridge of the notched disk, it is allowed to escape in the opposite direction and enter in the next notch. As a result, the kicker projection is protected from deformation and twisting as it is not forced to engage with the notched disk and it can also be actuated smoothly because no load is applied thereto even if it is operated while the drum is turning.

According to the present invention further, there is installed a movable frame made to turn in the same direction as the actuating frame when the actuating level is pulled forward, and the movable frame is returned to the original position when the hook is disengaged at the end of the lever pull, the front end of the movable frame being directly or indirectly equipped with detecting means, so that it may automatically be detected which one of the hit modes is involved. The sequence of operation is mechanically carried out through the coin discharge control mechanisms when the detecting means functions and, by controlling the angle of rotation of the coin discharge mechanism, the number of coins dischargeable is arranged to conform to the hit mode involved. Despite the fact that a plurality of hit modes are provided by incorporating detected projections, there is installed only one coin magazine and coins piled up therein are successively discharged in such a manner that the number of coins determined in conformity with the hit mode is discharged on a first-in-first-out basis. Moreover, because a special discharge mechanism in addition to the aforementioned mechanism is installed, it is made possible to discharge and recover the whole or a part of the coins stored in the coin bank upon completion of a game or on some other occasion.

The present invention has advantages including ensuring trouble-free operation during a game because it is only necessary to pull the actuating lever to complete every and all stages of operation from turning the drums up to discharging coins, so that the game may be made fully exciting. The advantages also include the capability of preventing the kicker from being damaged because the kicker is installed on a body different from the actuating frame and allowed to enter the notch of the index notched disk while it follows the actuating frame moving in the tilted direction and turns in the same direction thereof, that is, the kicker projections are not forced to engage with the notched disk.

The advantages further include the capability of automatically detecting the hit mode according to the permutation of what is displayed on the drum because the movable frame, turning in the same direction as the actuating frame when the actuating lever is pulled forward, and slowly returning to the original position when the hook disengages, from the actuating lever frame is installed together with a plurality of detecting means directly or indirectly provided at the front end of the moving frame. As the detecting means operates, a mechanical sequence operation is conducted through the coin discharge control mechanism, so that the number of coins determined in conformity with the hit mode involved may be discharged by controlling the angle of rotation of the coin discharge mechanism. The special discharge mechanism provided in addition to those aforementioned according to the present invention is capable of forcing the coin discharge mechanism to be rotationally driven pitch by pitch irrespective of the hit mode, using an external means, to discharge coins, whereby it is conveniently used to recover coins upon termination of a game or to inspect the inside of the machine after the recovery thereof.

BRIEF DESCRIPTION OF THE DRAWINGS

The foregoing objective and advantages of the invention will be apparent from the following description and accompanying drawings, wherein:

FIGS. 5 through 10 are across sectional views illustrating the actions of the kicker, the movable frame, projection and an actuating lever;

FIG. 14 is a front view of a coin bank;

DETAILED DESCRIPTION OF THE INVENTION

Figure 1:
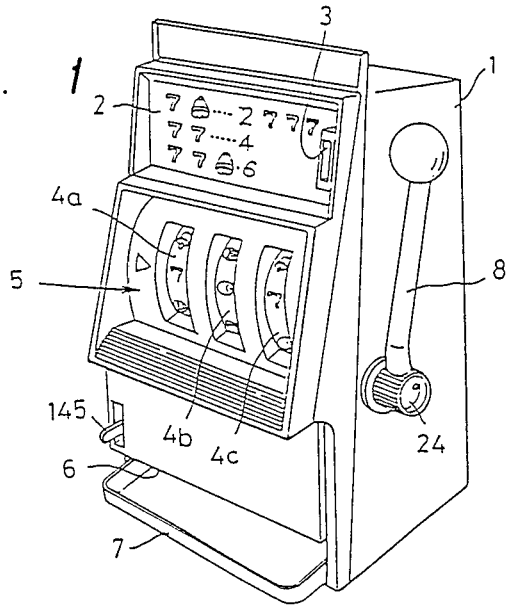
FIG. 1 is a perspective view of a slot machine embodying the present invention.

Referring now to the drawings, the present invention will be described.

A slot machine embodying the present invention is housed in a casing 1 shown in the perspective view of FIG. 1. The casing 1 is provided in its upper portion with a display panel 2 indicating the relation between a hit mode and the number of coins to be discharged, at the rightmost end thereof with a coin slot 3, in the front central portion with a plurality of windows 5 exposing portions of rotatable drums 4*a*, 4*b*, 4*c* housed therein, at its bottom with a coin outlet 6 and a tray 7 adjacent thereto and on one side thereof with an actuating lever 8.

Figure 2:
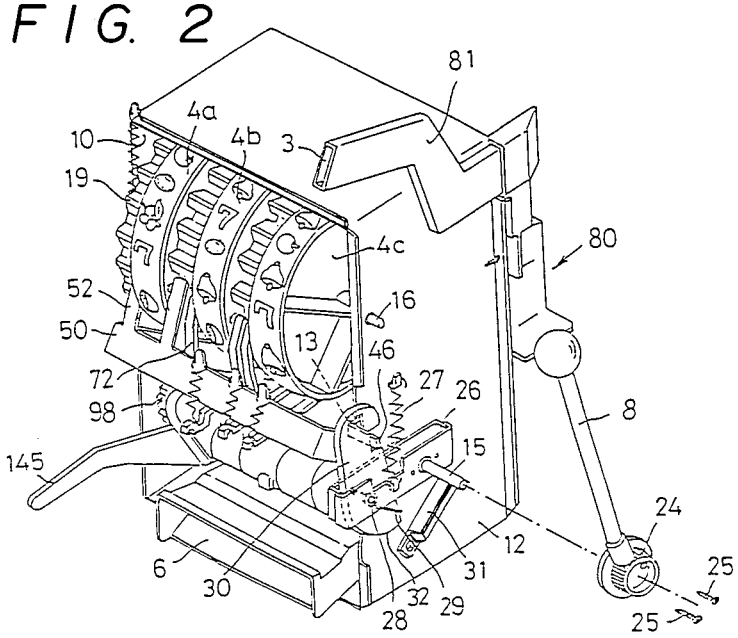
FIG. 2 is a perspective view illustrating the slot machine with its casing removed and viewed from an upper diagonal position.
Figure 3:
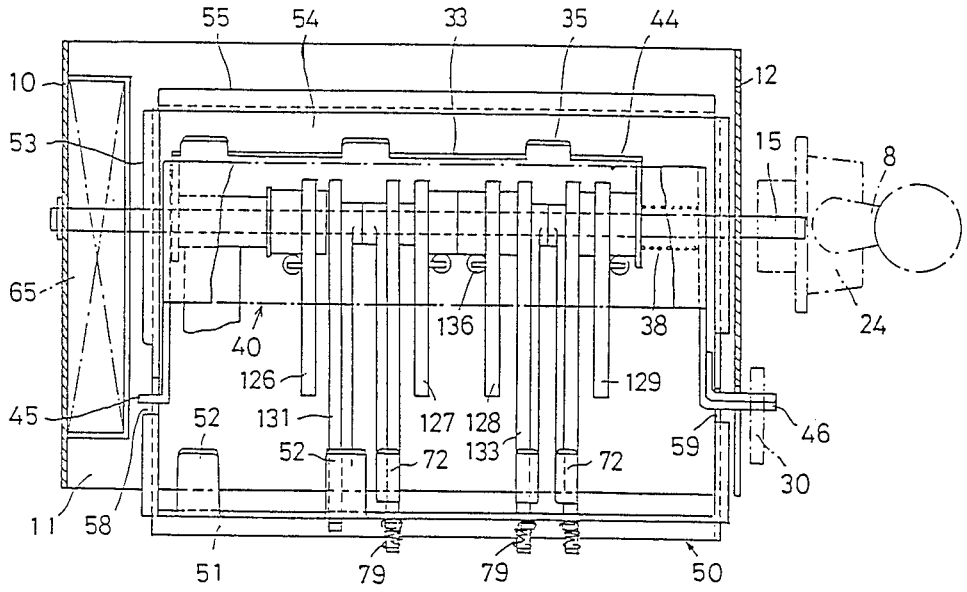
FIG. 3 is a top view illustrating portions where an actuating frame, a kicker and a movable frame are installed.

FIG. 2 is a perspective view of the slot machine as a whole without the casing 1. A boxlike frame 10 having its front and back open is fastened to a bottom plate 11 (FIG. 3). There are also provided a shaft 16 for supporting the drums and a main shaft 15 for mounting a drum rotating mechanism and so on between the upper right and lower left side plates of the frame 10.

The drums 4*a*, 4*b*, 4*c* are rotatably supported on the shaft 16. A number of pictures or symbols and the like are displayed on the outer peripheral face of each drum, the arrangements of the pictures or symbols being different from each other. An index notched disk 19 is incorporated on one side (for instance, the left side) of each drum. One end of the main shaft 15 is allowed to penetrate through the project from the casing 1 and the boss 24 of the actuating lever 8 is fixed thereto.

Figure 5:
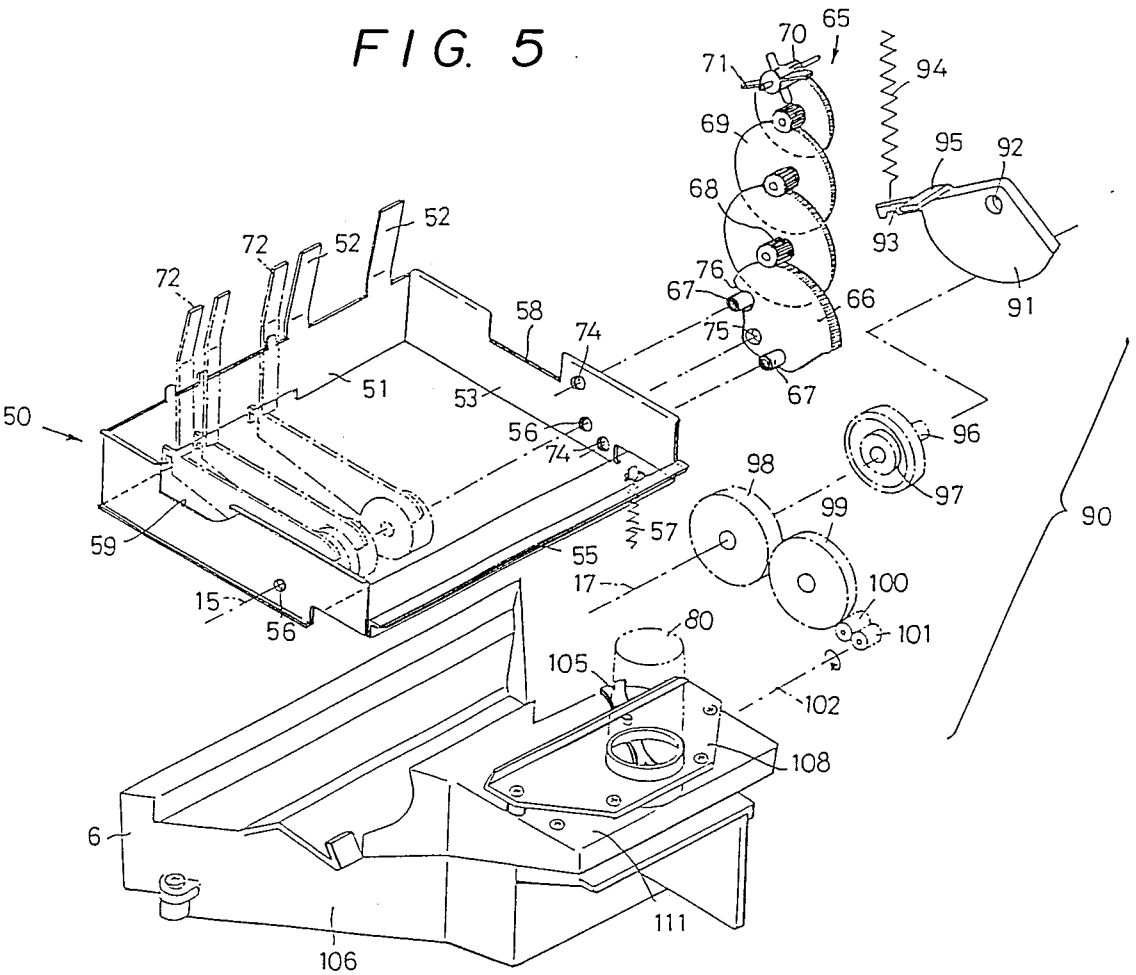
FIG. 5 is a perspective assembly drawing of the movable frame, a slow returning mechanism and a coin discharge mechanism.
Figure 6:
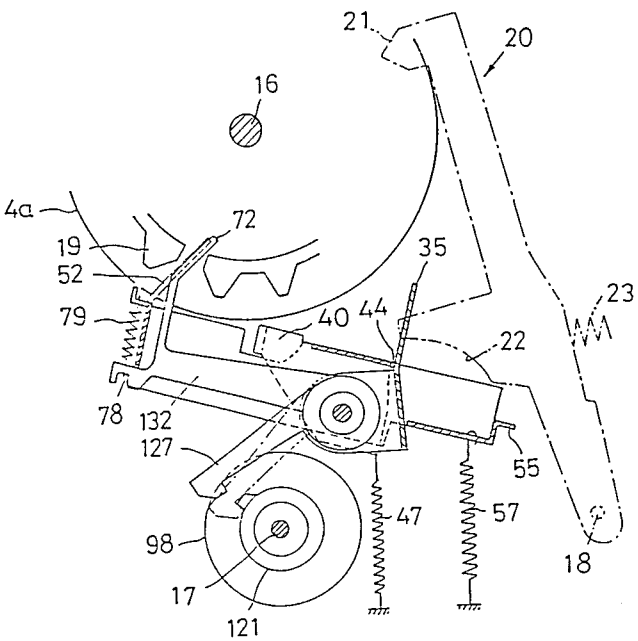

The actuating lever 8, if pulled forward by about 30 degrees, causes the projections 52 of a movable frame 50 constituting a detecting mechanism to be released from the index notched disks 19. On the other hand, a kicker 33 which will be described later in reference to FIG. 6, is allowed to enter the notched disks 19. The actuating lever 8, if pulled further forward by about 45 degrees, causes a hook 30 to be released as a slow return mechanism 65, which will be described later in FIG. 5, is charged with energy for slow operation and, due to the force of a spring 47, the slow return mechanism 65 is operated to allow the projections of the movable frame 50 to enter the corresponding notched disk of each respective drum. Simultaneously with the isolation of the hook mechanism, there is imparted force to a starting frame attached to the main shaft 15 causing the kicker 33 to return to its original position instantly and, with that force, all the drums are simultaneously rotated. As the slow return mechanism 65 is operated, projections 52 (or projections 72 for misentry) are successively operated to stop the drums, and it is then detected whether the display of each drum is stopped according to a predetermined permutation, whereby a coin discharge mechanism 90 (FIG. 5) is actuated.

The drums are driven by a drum rotating mechanism comprising the actuating lever 8, an arm frame 26, the hook 30 and the kicker 33. In other words, as shown in FIGS. 2 and 3, the main shaft 15 for mounting the actuating lever 8 is equipped with an actuating frame 40 for unidirectionally rotating the movable frame 50 for isolating the projections 52 from the notched disks 19, and there is provided within the actuating frame 40 the kicker 33 which is made to rotate in such a direction as to engage with the notches of the notched disks at all times. Moreover, the actuating frame 40 is provided with a tension bias spring 47 for turning actuating frame 40 to rapidly return from its end position produced when the actuating lever is pulled forward. In addition there is provided a press side 44 on actuating frame 40 returning the kicker to its original position while the actuating frame 40 returning to its original position.

Each part will now be described in detail.

Drums:

The three drums 4*a*, 4*b*, 4*c* in this embodiment of the present invention are rotatably mounted on the shaft 16.

Figure 11:
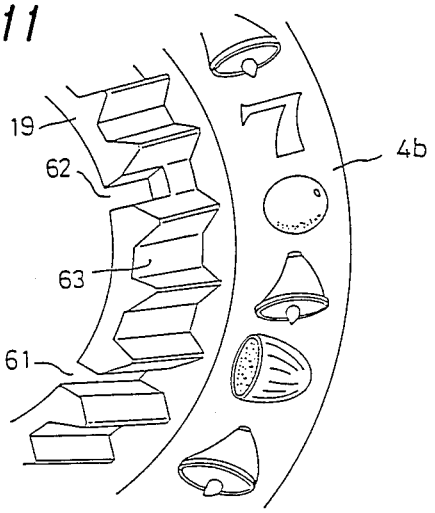
FIG. 11 is a partially enlarged perspective view of an index notched disk on the drum side.
Figure 12A:
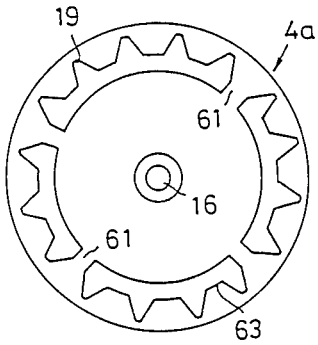
FIGS. 12A–12C are front view of notched disks.
Figure 12B:
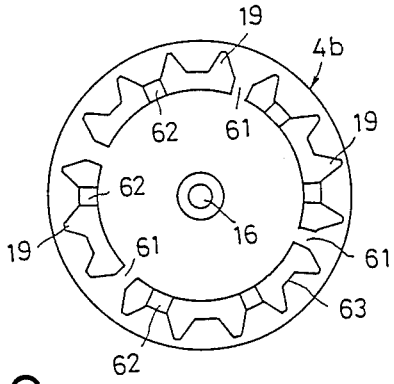
Figure 12C:
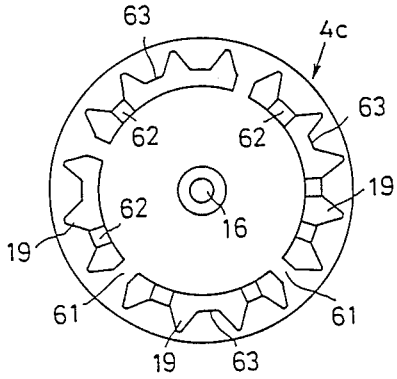

As shown in FIGS. 2 and 11, there are displayed on the peripheral face of each drum a plurality of, for instance, numerals "7" representing lucky seven, pictures such as bells, apples, cherries and water melons, and other characters, symbols and the like (16 of which pictures are arranged at a circumference pitch of 22.5 degrees in the case of the drums shown in the illustration) at predetermined intervals, whereas on the left side face of each drum is incorporated an index notched disk 19 having notches at a pitch in conformity with each picture. Each notched disk is provided therein with deep notches 61 without a bottom wall, arranged to correspond with a particular pictorial symbol (for instance, a lucky seven "7" and also provided with other notches with bottom walls or partial bottom walls. More specifically, as shown in FIGS. 12A–12C, the first notched disk of FIG. 12A has the 3rd, 6th, 11th and 15th notches thereof formed as deep notches 61 without a bottom wall viewing in the clockwise direction from the lowest one and the remaining notches thereof are formed with bottom walls 63. The second notched disk of FIG. 12B has the 3rd, 6th, 10th, 14th notches thereof formed as deep notches 61, the 2nd, 5th, 8th, 11th and 13th notches thereof formed as semi-deep notches, that is, some without bottom walls some with partial bottom walls 63 (see FIG. 11) and the remaining notches formed with bottom walls 63. Moreover, the third notched disk of FIG. 12C has the 3rd, 6th, 10th and 15th notches thereof formed as deep notches 61, the 2nd, 4th, 7th, 11th, 13th, 14th and 16th notches thereof formed as semi-deep notches with partial bottom walls 62 and the remaining with bottom walls 63.

As shown in FIG. 6, each drum before being started remains at a standstill because the claw 21 of a stopper 20 supported in the rear of the frame is engaged with the notched disk 19 on the drum side. The stopper 20 is supported on a shaft 18 horizontally provided to the rear of the main shaft 15. On the front side of the stopper 20 is formed a step cam 22 abutting on the rear plate edge 55 of the movable frame 50 described later, whereas on the rear side the stopper 20 there is provided a spring 23 for urging the front end of the claw 21 to always readily enter the notched disk 19.

Actuating lever and actuating frame:

The actuating lever 8 is, as aforementioned, fastened to one end of the main shaft 15 but not directly fixed to the main shaft; the arm frame 26 is fastened to the end of the main shaft 15 projected from the side plate 12 of the frame 10 as shown in FIG. 2 and the boss 24 is clamped to the arm frame with machine screws 25. The arm frame 26 is constantly biased to keep the lever 8 upright by means of a spring 27 and the front end of the arm frame 26 is equipped with a support shaft 28 for attaching thereto the hook 30 which is biased upright up by means of a spring 29.

A tilted guide 31 is fixed to the side plate of the frame close to the position where the actuating lever is attached and, if the arm frame 26 is completely turned by the actuating lever, a cam portion 32 on the under side of the hook will abut on the guide 31 and force the hook 30 to turn counterclockwise from its position in FIG. 2 against the torsion spring 29. As the hook 30 turns, it releases the engagement thereof with a projection 46 of the actuating frame 40 as described later and rapidly turns the actuating frame clockwise to implement the kick action.

Figure 4:
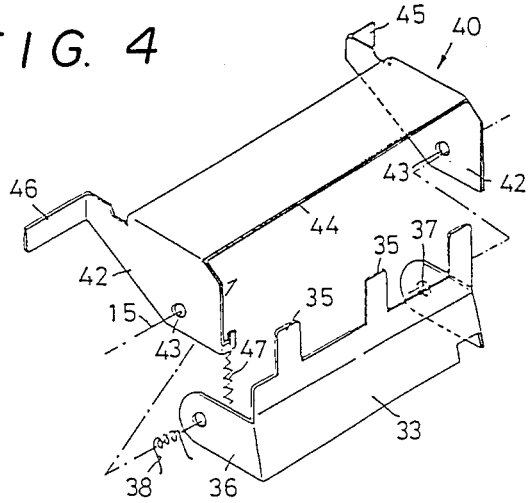
FIG. 4 is a perspective assembly drawing of the actuating frame and the kicker.

As shown in FIGS. 2 through 4, the actuating frame 40 is mounted on the main shaft 15 provided between the side plates 12, 12 of the frame 10 relative to the movable frame 50 and the kicker 33. That is, the actuating frame 40 is composed of a body proper having a length extending over the inside of the movable frame 50 and arms 42, 42 formed by twisting both ends of the body proper. Holes 43, 43 are provided in both arms to pass the main shaft 15 therethrough. The rear side of the body proper 41 is left as a press side 44 for driving the kicker 33 (see FIG. 7). The front ends of the arms are respectively outwardly bent and form projections 45, 46 engaging with respective grooves 58, 59 in the side plates 53, 53 of the movable frame 50. The projection 45 is short but long enough to engage with the groove 58 of the movable frame 50, whereas the other projection 46 is long enough to extend over the other groove 59 and the side plate 53 of the movable frame 50 so as to engage with the hook 30.

The strong tension spring 47 is provided between the lower portion of the arm 42 and the bottom plate 11 of the frame and the force of the spring is used to urge the actuating frame 40 to always readily turn clockwise as shown in FIG. 6 to the extent that it is not allowed to turn further as the projection 46 hits the end face 13 (FIG. 2) of a notch in the side plate 12 of the frame 10.

The actuating frame 40, the movable frame 50 and the kicker 33 are turned in unison while the hook 30 and the projection 46 engage with each other if the actuating lever 8 is pulled forward and, when the hook 30 disengages the projection 46 at the end of the lever pull, the actuating frame 40 and the movable frame 50 are turned in the direction (clockwise in FIGS. 6–8) opposite to that of the forward pulling of the actuating lever respectively by the force of the tension springs 47 and 57 relative to the bottom plate 11 of the frame. Then the actuating frame 40 is instantly turned in the return direction by the force of spring 47 and stopped when the projection 46 hits the end face 13 of the notch of the side plate 12 of the frame 10, whereas the movable frame 50 is, as described later, slowly turned in the reverse direction and returned to its original position. Movable frame 50 is rotatably mounted on the main shaft 15 via holes 56, 56 in the movable frame side plates 53 as shown in FIG. 5. In the final stage of the return process, each of the projections 52 of the movable frame 50 and the projections 72 of the detecting mechanism (to be described below) are allowed to enter the notches 61 or 62 of the notched disks 19 of each drum, so that the permutation in the display portion of each drum may be detected.

Kicker:

As shown in FIG. 4, the kicker comprises the kicker body proper 34, arms 36, 36 provided on both wings of the body 34 and three projections 35 above the upper side of the body 34. The projections 35 are arranged to correspond to the index notched disks 19, whereas the main shaft 15 is passed through the holes 37, 37 in the arms 36, 36. On the other hand, a torsion spring 38 is stretched between one arm 36 of the kicker and a corresponding arm 42 of the actuating frame 40 so as to always urge the kicker toward the notches of the notched disks 19, that is, in the counterclockwise direction in FIG. 6. However, the kicker body proper 34 is made to contact the press side 44 of the body of the actuating frame 40 in the normal state and prevented from turning.

Figure 7:
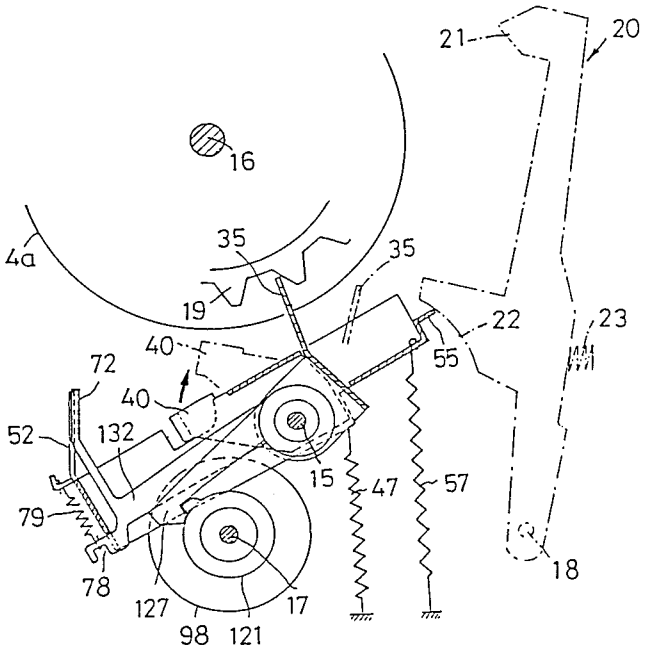
Figure 9:
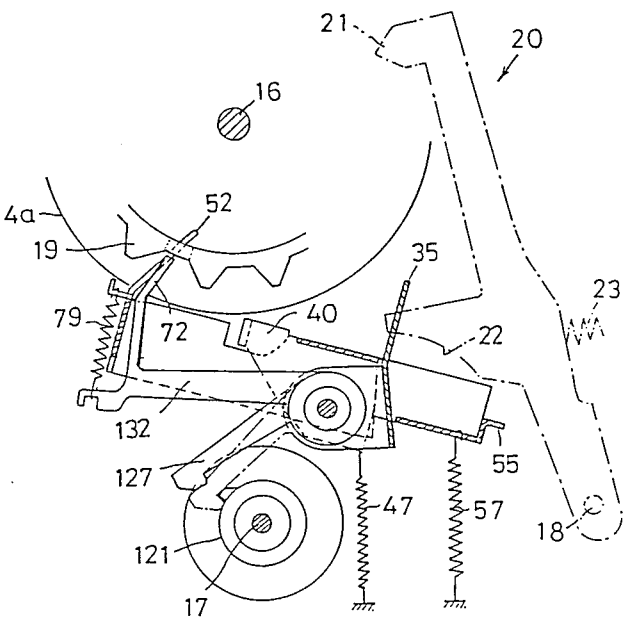
Figure 8:
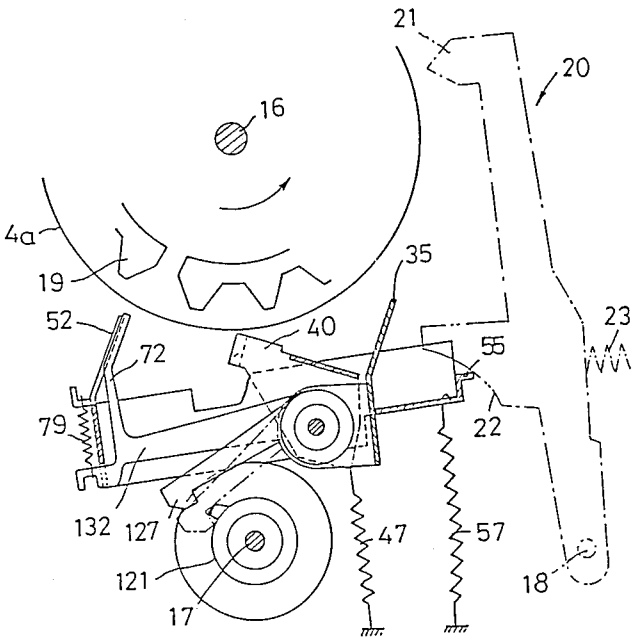
Figure 10:
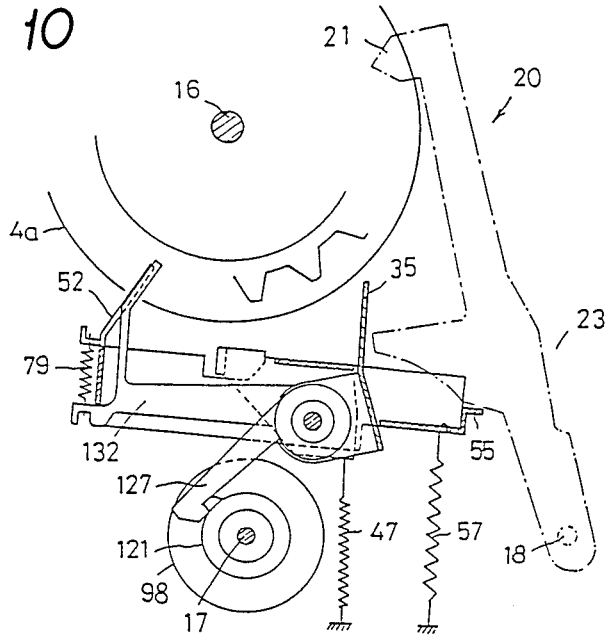

Since the actuating frame 40 and the movable frame 50 are turned conterclockwise in FIG. 6 when actuation is effected by the operation of the actuating lever, the kicker 33 is allowed to turn in the same direction of the former and therefore each kick projection 35 is able to enter a notch of the notched disks 19 (FIG. 7). When the hook 30 disengages the actuating frame 40 after the insertion of the kicker projections 35 in the notched disks 19, the actuating frame 40 is returned to its return condition rapidly by means of the strong spring 47 and the kicker 33 is pushed back by the press piece 44 formed in the rear of the body 41. Each of the drums **4*a*, 4*b*, 4*c* are, as shown in FIG. 8, turned counterclockwise rapidly when the kicker 33 is pushed back. In the meantime, as the movable frame 50 is not made to contact the notched disks 19 as aforementioned until the movable frame 50 returns to the end of its slow movement phase, the rotation of the drums is maintained for a certain period of time. As shown in FIGS. 6, 9 or 10, the drums are stopped at the end of the return phase. In the case of FIG. 6, there is shown a hit mode wherein all the front ends of the projections 52, 72 have entered in the notches 61 and, in the case of FIG. 9 the projection 52 directly formed at the front end of the movable frame 50 is made to enter the notch 61 without a bottom wall, whereas the projection 72 indirectly attached to the movable frame 50 abuts on the notch 63 with a bottom wall, whereby the standstill state of the drums is indicated. In the case of FIG. 10, all the projections 52, 72 are allowed to contact the notches 63** with bottom walls, whereby the drums are seen to stop without a hit mode.

Slow return mechanism:

There is provided a slow return mechanism 65 for slowly returning the movable frame 50 after the kick rotation phase. This slow-return mechanism 65 is, as shown in FIG. 5, supported by the main shaft 15 and comprises a pinion gear 68 meshing with a sector gear 66, the sector gear 66 fixed to one side plate 53 of the movable frame 50 through a pair of coupling pieces 67. A speedup gear train 69 in several stages follows the pinion 68 and drives an impeller 71 mounted on a gear shaft 70 in the final stage of the gear train. The sector gear 66 is incorporated with the movable frame by inserting the main shaft 15 in the shaft hole 75 and engaging coupling pieces 67, 67 provided on the side face of sector gear 66 with the holes 74, 74 in the side plate 53 of the movable frame. There is also formed a contact portion 76 at one end of the sector gear 66. The contact portion 76 is arranged so that it abuts on the attachment 95 of a sector gear 91 in the coin discharge mechanism which will be described later.

The sector gear 66, when actuated, together with the movable frame 50 is turned counterclockwise of its position shown in FIG. 5 but, as the movable frame is returned by the force of the spring 57 after the end of the actuating layer pull, the sector gear 66 turns clockwise and the movable frame 50 is slowly returned to its original position by the action of the gear train 69 headed by the pinion 68 and the impeller 71. In the meantime, the kicker 33 kicks back and this causes each drum to turn and, when the movable frame has completely returned, the detecting means as described subsequently enters to stop the drums.

Detecting means:

The detecting means is used to detect the stop position of each drum, that is, whether or not the display portion has stopped in the hit mode. In other words, since the drums **4*a*, 4*b*, 4*c* have been rotatably mounted on the shaft 16, the drum on the lefthand side is stopped first and successively the following ones are stopped when the stopper 20 is actuated even if the drums are simultaneously driven to turn by the kicker 33. However, it is not always ensured that each drum is stopped to display the same combination of pictures. The detecting means is designed to detect the symbol train displayed by the drums, when stopped, by inserting projections in the notches of the notched disks after the movable frame 50** has completely been turned.

The detecting means comprises first and second projections 52 directly upwardly extended from the front plate 51 of the movable frame 50 and third, fourth and fifth projections 72 indirectly provided in conjunction therewith. The first projection 52 is engaged with the notch of the first index notched disk, whereas the second projection is engaged with the notch on the free end side of the second index notched disk. The third projection is engaged with the notch of the second index notched disk, that notch being close to the drum side face, whereas the fourth projection is engaged with the notch on the free end side of the third index notched disk. Moreover, the fifth projection is engaged with the third index notched disk, that notch being close to the drum side face. As for the second through fifth projections, these projections are allowed to enter bottomless notches 61 of the index notched disks 19 and, when the projection involved enters a bottomless notch 61, the hit mode in each stage is detected.

As set forth above, although the first and second projections 52, 52 are directly upwardly projected from the front plate 51 of the metal movable frame 50, the third and fifth projections 72 are incorporated in operating levers 131–134 (FIGS. 3, 20) rotatably provided along the main shaft 15 and in addition each operating lever 131, 134 equipped with a hook 78 with a spring stretched between the lever and the front plate of the movable frame, so that the lever may be supported resiliently. This spring 79 is intended to make the operating levers 132–134 static so as to allow the coin discharge control mechanism to operate properly when the projections 72 following the third one are not caused to enter the notches 61 despite the fact that the first and second projections 52 have been caused to enter the notches 61. The hit mode depending on the stop positions of the drums need not be limited to one kind. For instance, assuming that, with an arrangement of lucky seven and bell marks as a basis, there are four (No. 1, No. 4) hit modes when the drums 4*a*, 4*b*, 4*c* stop to display:

7 bell mark, 7 7, 7 7 bell mark and 7 7 in order, respectively. The Table below illustrates the relation between the position where each projection enters the notch of the notched disk and the hit mode.

| | Position where projections 52, 72 enter: | | |
|---|---|---|---|
| Hit mode: | First notched disk: | Second Notched disk: | Third notched disk: |
| No. 1 | Deep notch (61) | Deep notch (62) | Deep notch (63) |
| No. 2 | Deep notch (61) | Deep notch (61) | Deep notch (63) |
| No. 3 | Deep notch (61) | Deep notch (61) | Deep notch (62) |
| No. 4 | Deep notch (61) | Deep notch (61) | Deep notch (61) |

When the projection is caused to enter any position other than the aforementioned, it is assumed there is no hit and thus no coins are discharged. Depending on the hit mode, 2, 4, 6 or 10 coins, for instance, are automatically discharged in the order of first-in-first out.

Figure 15:
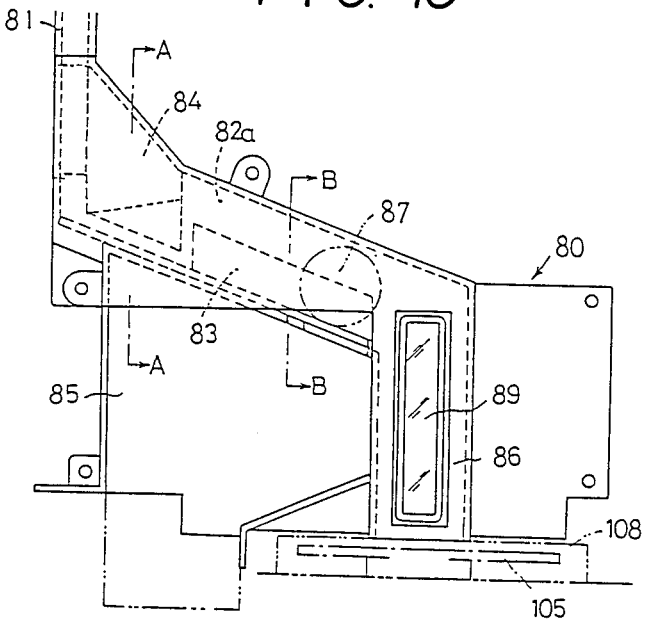
FIG. 15 is a cross sectional view of FIG. 15 taken on line 16—16.

Coin bank:

The coin bank is designed to store coins having predetermined diameters and those other than the predetermined ones are discharged into a reject chamber. As shown in FIGS. 5, 15, the coin bank is installed in the rear of the machine. There is provided a tilted passage 82 through a direction changer 84 for changing the flow of coins in the direction perpendicular to the end of an inlet 81 leading from the coin slot 3 (FIGS. 1, 2) on the front panel of the of the machine. A cylindrical coin magazine 86 is installed vertically at the downstream end of the tilted passage 82. The tilted passage is formed with a tilted face 82*a* and the bottom 82*b* and there is also provided along the tilted face 82*a* an opening for dropping small diameter coins 88 in the reject chamber 85.

Figure 16:
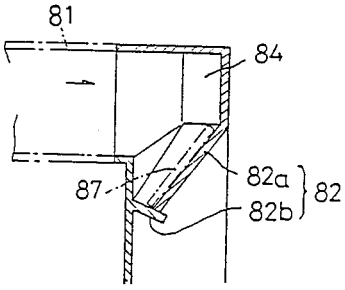
Figure 17:
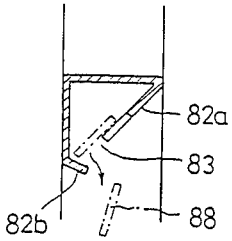
FIG. 17 is a cross sectional view of FIG. 15 taken on line 17—17.

Taking a 25 cent coin as a reference, those large in diameter than a 25 cent coin are regulated by the coin slot 3 and rejected at the inlet 81. The standard coins 87 and those coins 88 smaller in diameter are introduced in the tilted passage 82 through the inlet 81 and the direction changer 84. The standard coins 87 are, as shown in FIGS. 15, 16, rolled down along the titled passage 82 before being piled up in the coin magazine 86. Small diameter coins (for instance, 10 or 5 cent coins) are discharged into the reject chamber 85 through the opening 83 (FIG. 17). The coin magazine is provided with a seethrough window 89 vertically extended, so that the quantity of the coins may be confirmed from outside. In the lower portion of the magazine 86 is arranged a Geneva gear for the coin discharge mechanism subsequently described. There is also installed a door (not shown) in the side wall of the reject chamber 85 in order to recover the coins rejected.

Coin discharge mechanism:

This mechanism is designed to discharge the coins piled up in the coin magazine 86 from the bottom side thereof and constructed of a sector gear 91 mounted on one end of the main shaft 15, a spring 94 for energizing the sector gear 91 to drive same unidirectionally, and a Geneva gear 105 operating to discharge the predetermined number coins per pitch and a gear train provided between the sector gear 91 and the Geneva gear 105.

Figure 13:
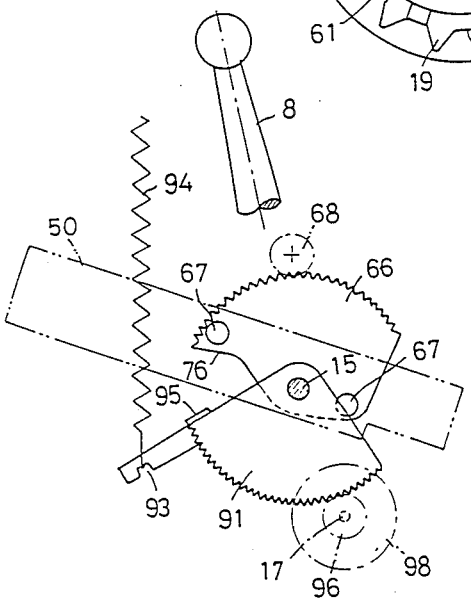
FIGS. 13 and 14 are front views of sector gears at a standstill and in operation.
Figure 18:
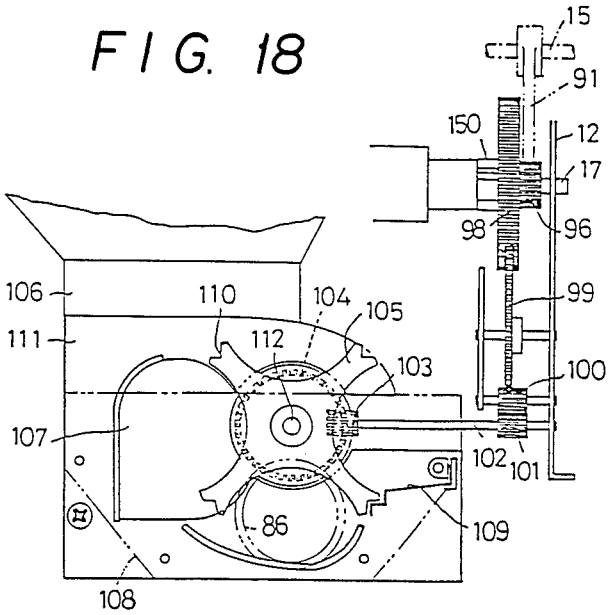
FIG. 18 is a top view of the coin discharge mechanism.

More specifically, as shown in FIG. 5, there is provided the sector gear 91 for actuating discharge operation on the main shaft in such a position as outside the sector gear 66 for the slow return mechanism 65. However, the sector gear 91 is made idle since the main shaft 15 is passed through the shaft hole 92 and is always urged to readily turn clockwise of its position FIG. 5 because the gear 91 is equipped with the hook 93 at one end for engagement by the spring 94. There is also provided and attachment 95 close to the hook 93 and capable of abutting on the contact 76 of the sector gear 66 of the slow return mechanism. Although the attachment 95 is kept apart from the contact 76 as shown in FIG. 13 prior to actuation, it is allowed to abut on the contact 76 as the sector gear 66 is caused to turn by the pulling forward of the actuating lever 8. Moreover, if the lever is further pulled forward, the sector gear 91 will be turned in the same direction as the sector gear 66 against the force of the springs 57, 94 and turned as shown in FIG. 7 when the lever is completely pulled forward and further returned to the original position when the hook in the drum rotating mechanism disengages. Although the sector gear 66 slowly returns because of the function of the slow return mechanism 65, the sector gear 91 tries to turn clockwise of its position in FIG. 7 due to the force of the spring 94. The sector gear 91 has been engaged with a pinion 96 fixed to the control shaft 17 under the main shaft and equipped with a gear 98 on one side of the pinion 96 through a one-way clutch 97. Accordingly, the torque of the sector gear 91 after it has returned to the original position is transmitted from the pinion 96, the one-way clutch 97 and the gear 98 to the Geneva gear 105 through a gear train engaging with the gear 98, the gear train comprising a pair of pinions 100, 101, a shaft 102, a gear 103 and a crown gear 104 (FIGS. 5, 18, 19).

The Geneva gear 105 is coaxially fixed with the shaft 112 of the crown gear and has four sides each so shaped and thick enough to store therein two of the piled up coins and capable of discharging two coins 86 at a time per pitch rotation (a pitch rotation being a quarter turn). The Geneva gear 105 is attached to the side of an inlet (FIG. 18) in the upper step 111 of a discharge chute 106 and the upper face of the step 111 excluding a portion thereof coupled to the coin magazine 86 is covered with a presser plate 108. Moreover, a laminated spring 109 is provided on the step 111 in such a position as to be roughly symmetrical with the inlet and engaged with the front end recess 110 of the Geneva gear and used as a stopper therefor. The discharge chute 106 has a frontal tilted face covering an area from the inlet 107 to the discharge port 6 (FIG. 2).

Figure 19:
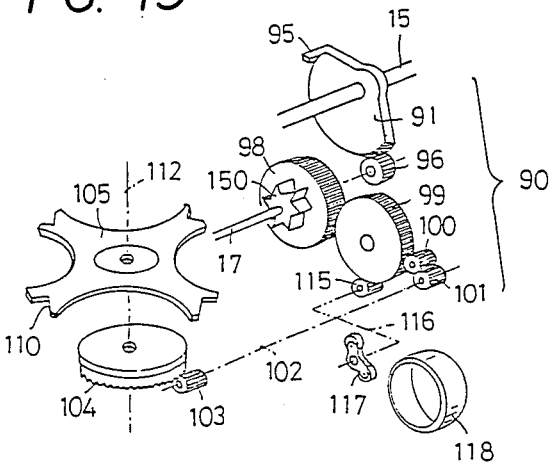
FIG. 19 is a perspective assembly drawing of the same.

Moreover, as shown in FIG. 19, another pinion 115 is engaged with an intermediate gear 99 and a rotor 117 is attached to the shaft 116 thereof to provide a mechanism for sounding a bell 118 when coins ought to be discharged.

Coin discharge control mechanism:

This mechanism 120 is designed to control the number of coins to be discharged according to the hit mode relative to the drums and is equipped with a stopper drum 121 fastened to the control shaft 17, a plurality of projections 122–125 arranged on the surface of the stopper drum 121 at intervals in the directions of its rotation and axis; Notched member 126–129 are suspended from off to the side of the stopper drums axis for the purpose of engaging with the projections 122–125 respectively, and for operating the levers 131–134 for letting the projections 52 or 72 disengage from the notched members, and for determining the angle of rotation of the horizontal shaft 17 when a projection 52 or 72 is caused to enter a notch 61 without a bottom wall of an index notched disk 19.

Figure 20:
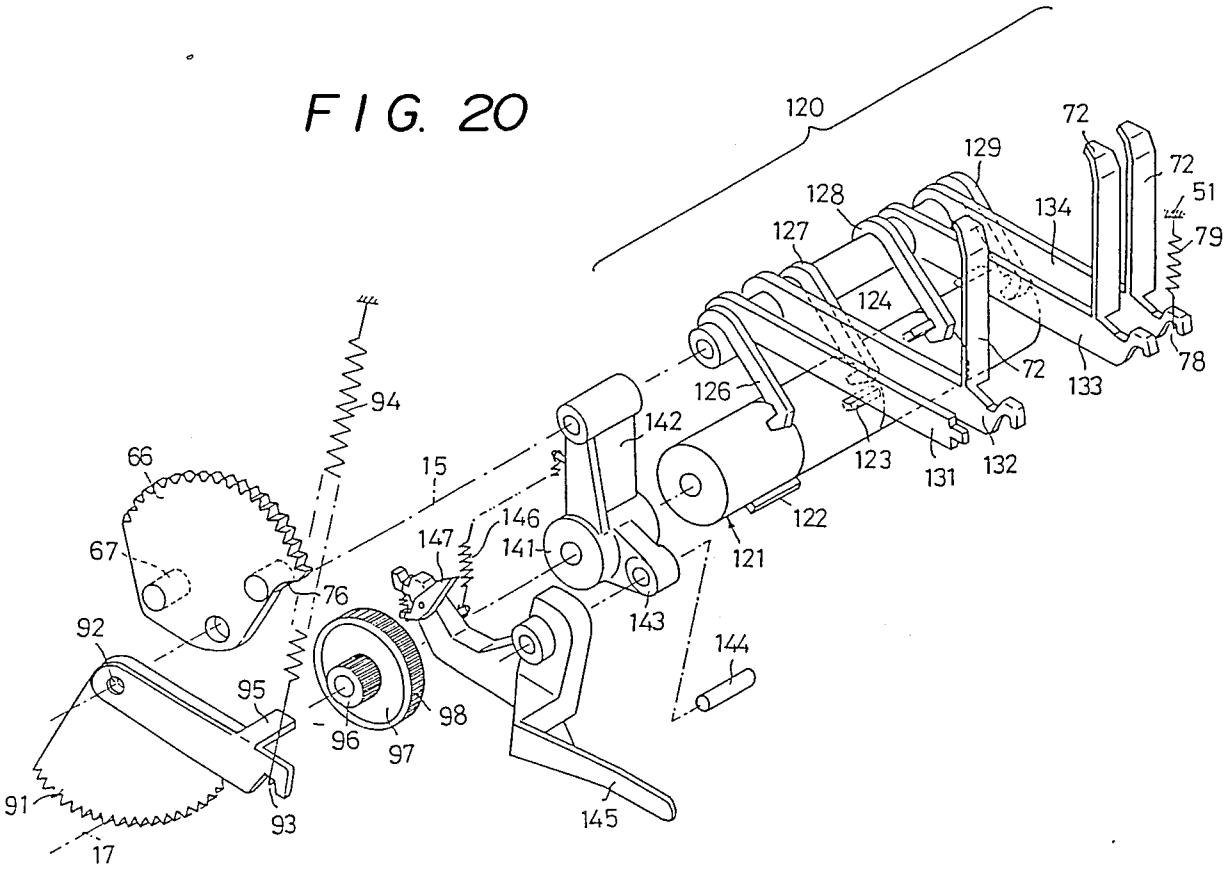
FIG. 20 is a perspective assembly drawing of a coin discharge control mechanism and a special discharge mechanism.

The control shaft 17 is equipped with the pinion 96 engaging with the sector gear 91 of the coin discharge mechanism 90 and also the stopper drum 121 shown in FIG. 20 is mounted thereon. The projections 122–125 of the stopper drum 121, if shifted by, for instance, 60 degrees in phase, will cause the control shaft 17 incorporated in the stopper drum to turn 60 degrees as the first projection 122 comes off stopper drum 121 in the case of the No. 1 hit mode, and to turn 120 degrees as the projections 122 and 123 come off stopper drum 121 case of the No. 2 hit mode, because the shaft 17 has also been given torque by the spring of the sector gear 91. In the case of the No. 3 hit mode, the projections 122–124 come off stopper drum 121 and the shaft 17 is turned 180 degree and is turned about 300 degrees as the projections 122–125 come off stopper drum 121 in the case of the No. 4 hit mode.

The notched members 126–129 are coupled to the projections 52 and 72 through the operating levers 131–134 and provide the horizontal shaft 17 with an angle of rotation corresponding to the No. 1–No. 4 hit modes as mentioned above depending on the way the projections are actuated.

Each operating lever is idly mounted on the main shaft 15 and the front end of the first operating lever 131 is fastened to the front plate 51 of the movable frame 50 (FIG. 3), whereas the second-fourth operating levers 132–134 are formed in unison at the lower end of each projection 72.

Figure 21:
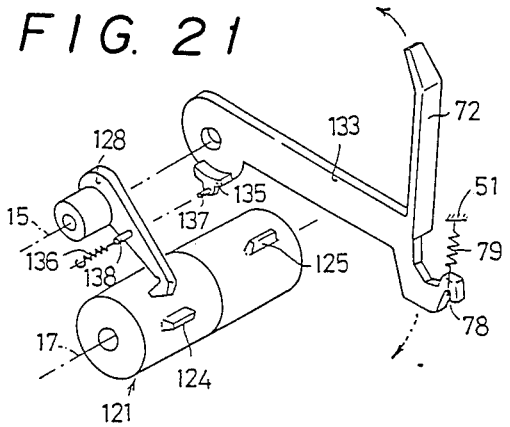
FIG. 21 is a perspective assembly drawing illustrated the relation between the actuating lever and notched member.

The notched members 126–129 are normally allowed to touch the surface of the stopper drum 121 and so constructed that they are forced to detach from the surface of the drum when the operating levers 131–134 rotate. FIG. 21 is an exploded view of the third operating lever 133 together with the notched member 128 to make clear the mechanism of forced separation, wherein a pin 137 is provided in the direction parallel with the main shaft 15 by forming a step 135 in the form of an arc in the boss of the operating lever 133. On the other hand, a pin 138 extends from close to the base of the notched member 128 and a spring 136 is stretched between both pins 137, 138. The operating lever 133 is turned clockwise as shown by a dotted line in FIG. 21 depending on the movement of the movable frame 50 when it is actuated on the movement of the movable frame 50 when it is actuated and the notched member 128 is also turned in the same direction because the spring 136 is extended, whereby the front end of the claw is pressed against the surface of the stopper drum 121. As the angles of rotation of the projection and operating lever are small when the projection 72 corresponding to each operating lever abuts on the notch 63 and is caused to stop, the notched member 128 is still kept pressed against the surface of the stopper drum. On the contrary, when the projection 72 is allowed to enter the notch 61 without a bottom wall, the angle to rotation becomes large and consequently the side face of the step 135 of the operating lever 133 presses the lower end face of the notched member, whereby the notched member is turned counterclockwise of its position in FIG. 21 to force the projection 124 to disengage from the notch of notched member 128.

Although the projections 122–125 are so arranged as to be 60 degrees out of phase with each other, the relation between the hit mode, rotation of the Geneva gear and the number of coins to be discharged will be shown in the following Table.

| Hit mode: | Rotation of control shaft 17: | Rotation of Geneva gear: | Number of coins to be discharged: |
|---|---|---|---|
| No. 1 | 1/6 | 1/4 | 2 |
| No. 2 | 2/6 | 2/4 | 4 |
| No. 3 | 3/6 | 3/4 | 6 |
| No. 4 | 5/4 | 5/4 | 10 |

To implement the aforementioned discharge relative to the rotation, the ratio of the number of teeth of the large gear (number of teeth=98:99) to that of the crown gear 105 and the pinions (100, 101, 103) should be maintained at 6:4:1 (for instance, the number of teeth is 72:48:12).

Figure 22:
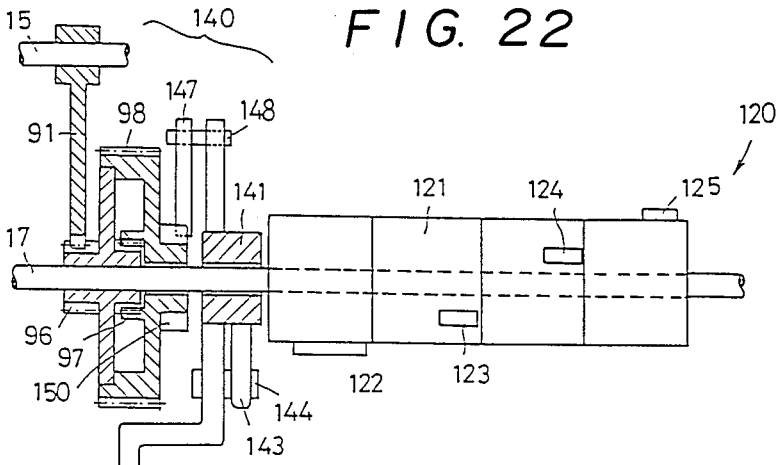
FIG. 22 is a top view of the special discharge mechanism.
Figure 23:
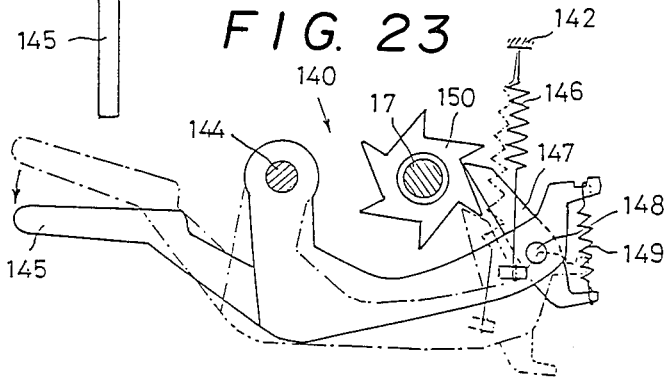
FIG. 23 is a side view of the same.

Special discharge mechanism:

This mechanism is intended to force coins to be discharged irrespective of the presence of the hit mode and is illustrated in FIGS. 20, 22, 23.

As set forth above, the control shaft 17 is equipped with the pinion 96 engaging with the sector gear 91 and the stopper drum 121, whereas the gear including the one-way clutch 97 and a boss proper 141 of the special discharge mechanism are idly provided therebetween. The front end of an arm 142 extending upwardly from the boss proper 141 is passed through by and supported by the main shaft 15 and a bracket 143 extending in a direction roughly perpendicular to that of the arm 142 is provided with a discharge lever 145 connected thereto by a pin 144. The lever 145 if made rotatable clockwise (counterclockwise in FIG. 23) by hooking the spring 146 on one side of the front end of the lever 145 and, using a spring 149, the lever 145 is engaged with a notched disk 150 formed on the side of the gear 98, by fixing a ratchet 147 to the other end of the lever 145 using a pin 148.

As shown in FIGS. 5, 18, 19, because the gear 98 has been engaged with the gear 99 of the coin discharge mechanism 90, if the gear 98 is turned externally, the discharge mechanism may be driven irrespective of the hit mode. As the front end of the discharge lever 145 is allowed to project at the left lower corner of the front panel of the machine as shown in FIG. 1, a notched disk 150 is moved one pitch by moving the lever 145 from the state shown in FIG. 23 a chain line to the state shown by a solid line to drive the ratchet 147. The one pitch rotation allows the Geneva gear 105 to turn one pitch. Accordingly, two piled coins are successively discharged each time the lever 145 is moved up and down and it is thus possible to discharge the desired number of coins or all of them stored in the coin magazine 86 by repeating the operation.

Functions:

This machine is designed to discharge coins according to the hit mode by detecting the stop position of the drums using the detecting means and controlling the operation of the coin discharge mechanism 90 by means of the coin discharge control mechanism.

The actuation of this machine will be described first.

In FIG. 3, if the actuating lever 8 is pulled forward, the arm frame 26 incorporated with the lever 8 through the boss 24 and the hook 30 pivotally fastened to the arm frame 26 are turned counterclockwise in FIGS. 6, 13. As they are so turned, the edge 55 of the rear plate of the movable frame abuts on the step cam 22, causing the stopper 20 to turn clockwise and releasing the engagement of the notched disks 19 by the claws 21, whereas the projection 35 is caused to enter the notch of the notched disk and move the disk in the same direction up to the end of the lever pull in FIG. 14. At the end of the lever pull, the cam 32 of the hook 30 abuts on the guide 31 (FIG. 2) to turn the hook upside down and release the engagement thereof with the projection 46. Simultaneously with that disengagement, the actuating frame 40 is made to turn clockwise rapidly by the force of the spring 47 while the movable frame 50 is left along (FIG. 7) and the projection 46 is allowed to abut on the notched end face 13 of the side plate 12 on the frame 10, so that the actuating frame 40 may be returned to the original position. When the actuating frame 40 is abruptly returned to the original position, it presses and turns the kicker body proper 34 with the presser side 44 of the actuating frame. Accordingly, the kick projection 35 is rapidly turned clockwise as shown in FIG. 8 and the drums 4*a*, 4*b*, 4*c* are turned in the counterclockwise direction of the arrow in FIG. 8 in unison.

Thus, the kicker 33 is formed of a body different from that of the actuating frame 40 and caused to enter the notch of the index notched disk 19 while following the actuating of and turning in the same direction of the actuating frame. When the kick projection 35 is caught by the ridge of the notched disk 19 at the time of the operation of the actuating lever, it will be allowed to escape in the opposite direction against the torsion spring 38 and properly enter the notch, so that notched disk 19 may be prevented from being thereafter forced to engage with the kick projection 35.

Simultaneously when the actuating frame 40 starts to return, the projections 45, 46 that have engaged with the grooves 58, 59 of the movable frame on the movable frame side will detach therefrom. Consequently, the movable frame 50 attempts to turn clockwise because of the force of the spring 57 but it will slowly turn and return as the slow return mechanism 65 comprising the sector gear 66 and the gear train 69 operates. The projections 52, 72 are caused to enter the notches of the notched disk 10 successively near the end of the return operation. On the other hand, the edge 55 of the rear plate of the movable frame enters the cam 22 of the stopper and the claws 21 successively engages with the notch of each notched disk, thus stopping each drum. The arrangement displayed on each stopped drum is detected by the detecting projections and the predetermined number of coins is discharged according to the aforementioned hit mode.

Additional functions and features of this machine will be now described.

Figure 14:
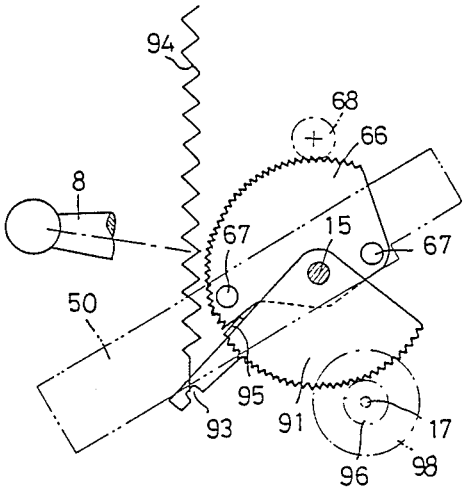

As the actuating lever 8 is pulled forward, the actuating sector gear 66 together with the actuating frame 40 and the movable frame 50, as shown in FIG. 14, turn causing the coin discharge mechanism 90 to be energized. Then each notched member 125–129 is pressed against the stopper drum 121 as shown in FIGS. 20, 21 and the coin discharge mechanisms 120 is set.

The detecting means operates during the period from the operation of the kicker 33 to the termination of the rotation of the drums and judges whether or not a hit mode is present. The coin discharge mechanism 120 will not operate when a hit mode is absent and thus no coins are discharged.

In the case of hit mode No. 1, two detecting projections 52, 52 directly fixed to the movable frame 50 enter the notches 61 without bottom walls of the first and second notched disks, turning the first notched member 126 through the operating lever 131, causing the projection 122 of the stopper drum to be released and allowing the control shaft 17 to rotate 1/6 turn. The 1/6 rotation of the control shaft 17 acts to drive the gear train of the coin discharge mechanism 90 and causes a one pitch turn the Geneva gear 105 to discharge two coins. In the same manner, the No. 2 and following hit modes are detected depending on the way each detecting projection enters, and 4, 6 and 10 coins are discharged by 2/6, 3/6, or 5/6 turning the stopper drum 121 turns within only the range of 1/6 to 5/6 rotation successively and never turns from 1/6 to 5/6 rotation directly.

The special discharge mechanism will operate if any mechanical failure including that of the kicker drum, the coin discharge mechanism, etc. other than the discharge of coins on termination of a game occurs. The order of the operation is as follows:

The lever 145 projected forwardly from the machine is moved upward and the notched disk 150 is turned by one pitch at a time by means of the ratchet 147. Since the ratchet 147 is kept abutting on the notched disk 150 on the control shaft 17 by the spring 149, it will rotate 1/6 turn if the lever 145 is pulled, causing the Geneva gear 104 to rotate ¼ turn for discharging two coins through the coin discharge mechanism. Two coins are thus discharged each time the lever 145 is moved to empty the coin bank 80. As the lever is moved up and down, the rotor bar 117 attached to the coin discharge mechanism 90 is turned and the bell 118 is sounded each time the one pitch discharge is implemented.

While there has been shown and described the fundamental novel feature of this invention as applied to the preferred embodiment, it will be understood that various omissions and substitutions and changes in the form and details of the device illustrated may be made by those skilled in the art without departing from the spirit of the invention. It is the intention therefore to be limited only by the scope of the following claims and reasonable equivalents thereof.

What is claimed is:

1. A slot machine, comprising:

a main frame having a pair of side plates;

a main shaft rotatably supported between said main frame side plates;

an actuating lever means carried on one end of said main shaft;

a movable frame rotatably supported on said main shaft and adapted for movement in a first direction from an original position thereof and for slow return movement in an opposite second direction to said original position thereof upon pulling of said actuating lever means;

a plurality of drums rotatably mounted on said main shaft, each said drum having a peripheral face displaying a plurality of specific symbols;

an index notched disk incorporated on a side of each of said drums;

a kicker means rotatably carried on said main shaft and elastically urged to rotate thereabout in a first direction upon pulling of said actuating lever means;

a kicker energizing means for energizing said kicker means upon pulling of said actuating lever means, for turning said plurality of drums in unison to rotate said drums and releasing said kicker means to cause rotation of said kicker means in a second direction about said main shaft opposite said first direction, upon the pulling of said actuating lever means all the way to the end of a forward excursion thereof;

a slow return mechanism for slowly returning said movable frame to its said original position after actuation of said kicker means;

a detecting means for engaging with said index notched disks provided on said drums at the end of said slow return of said movable frame to said original position thereof, said detecting means stopping rotation of said drums in succession and detecting hit modes of said stopped drums according to the permutation of specific symbols displayed on said drums;

a coin bank installed in a rear portion of said main frame; and a coin discharge mechanism for discharging coins slotted into and stored in said coin bank, in accordance with a particular hit mode detected by operation of said detecting means.

2. A slot machine as claimed in claim 1, wherein each said index notched disk is formed with a plurality of notches therein including notches having bottom walls, and notches without bottom walls permitting entry therethrough of detecting projections provided in said detecting means.

3. A slot machine as claimed in claim 2, wherein each said index notched disk is further formed with semi-open notches therein having bottom walls formed on a side of said index notched disk proximate said drum, said semi-open notches having openings formed through said bottom walls thereof remote from said drum.

4. A slot machine as claimed in claim 2, wherein said coin discharge mechanisms comprises;

a stopper drum fixed for rotation on a control shaft under said main shaft;

a plurality of stopper projections arranged on said stopper drum at axial intervals therealong, said stopper projections being further arranged at differing angular phases with one another around said stopper drum;

a plurality of notched members suspended above said stopper drum and carried on said main shaft, said notched members being engageable with said stopper projections on said stopper drum; and a plurality of operating lever means carried on said main shaft and being operable for disengaging said notched member from said stopper projections upon entry of corresponding detecting projections of said detecting means into open-bottomed notches of said index notched disks, disengagement of different ones of said notched members from said stopper projections determining the angular rotation of said control shaft.

5. A slot machine as claimed in claim 1, wherein said coin discharge mechanisms comprises;

a stopper drum fixed for rotation on a control shaft under said main shaft;

a plurality of stopper projections arranged on said stopper drum at axial intervals therealong, said stopper projections being further arranged at differing angular phases with one another around said stopper drum;

a plurality of notched members suspended above said stopper drum and carried on said main shaft, said notched members being engageable with said stopper projections on said stopper drum; and a plurality of operating lever means carried on said main shaft and being operable for disengaging said notched member from said stopper projections upon entry of corresponding detecting projections of said detecting means into open-bottomed notches of said index notched disks, disengagement of different ones of said notched members from said stopper projections determining the angular rotation of said control shaft.

6. A slot machine as claimed in claim 1, wherein said coin discharge mechanism includes:

first and second sector gears rotatably carried on said main shaft and rotating in the same direction as said actuating lever means when said actuating lever means is pulled forward;

a spring urging said first and second sector gears to return to respective original positions thereof after releasing of said actuating lever means;

a pinion gear fixed on an end of a control shaft provided under said main shaft, said pinion gear meshing with said first sector gear;

a Geneva gear mounted for rotation under said coin bank; and a gear train arranged between said pinion gear and said Geneva gear for driving said Geneva gear to rotate;

whereby rotation of said Geneva gear by one pitch thereof discharges a predetermined number of coins from said coin bank.

7. A slot machine, comprising:

a main frame having a pair of side plates;

a main shaft rotatably supported between said main frame side plates;

an actuating lever means carried on one end of said main shaft;

hook means adapted for actuation by pulling of said actuating lever means; said hook means being positioned next to one side plate of said main frame;

an actuating frame rotatably carried on said main shaft and elastically energized to inclinedly rotate thereabout by the operation of said actuating lever means;

a movable frame rotatably supported on said main shaft and adapted for movement in a first direction from an original position thereof and for slow return movement in an opposite second direction to said original position thereof upon pulling of said actuating lever means; said movable frame being engaged by said hooks means and disengaged therefrom upon actuation of said actuating lever means;

a plurality of drums rotatably mounted on said main shaft, each said drum having a peripheral face displaying a plurality of specific symbols;

an index notched disk incorporated on a side of each of said drums;

a kicker means rotatably carried on said main shaft and elastically urged to rotate thereabout in a first direction upon pulling of said actuating lever means;

a kicker energizing means for energizing said kicker means upon pulling of said actuating lever means, for turning said plurality of drums in unison to rotate said drums and releasing said kicker means to cause rotation of said kicker means in a second direction about said main shaft opposite said first direction, upon the pulling of said actuating lever means all the way to the end of a forward excursion thereof;

a slow return mechanism for slowly returning said movable frame to its said original position after actuation of said kicker means;

a detecting means for engaging with said index notched disks provided on said drums at the end of said slow return of said movable frame to said original position thereof, said detecting means stopping rotation of said drums in succession and detecting hit modes of said stopped drums according to the permutation of specific symbols displayed on said drums; said detecting means having a plurality of projections directly and indirectly attached to a front end of said movable frame, said detecting means turning in the same direction of said actuating lever means when said actuating lever means is pulled forward and slowly returning to an original position thereof after disengagement of said movable frame from said hook means;

a coin bank installed in a rear portion of said main frame; and a coin discharge mechanism for discharging coins slotted into and stored in said coin bank, in accordance with a particular hit mode detected by operation of said detecting means.

8. A slot machine as claimed in claim 7, wherein said kicker means includes:

a kicker body proper having a plurality of kick projections corresponding to said index notched disks on said drums;

a pair of arms extending perpendicularly from opposite ends of said kicker body proper, each of said arms having a hole formed therein for passing said main shaft therethrough; and a torsion spring provided between one arm of said kicker means and a corresponding arm of said actuating frame for urgingly acting therebetween.

9. A slot machine as claimed in claim 7, further comprising:

a special discharge mechanism for actuating said coin discharge mechanism to operate through one pitch of a rotation thereof to discharge coins irrespective of the occurrence or nonoccurrence of a hit mode, said special discharge mechanism having a horizontal control shaft provided under said main shaft, a discharge lever rotatably mounted on said main shaft, a gear drivingly coupled to said coin discharge mechanism, said gear being rotatably mounted on said control shaft and including therein a one-way clutch, a notched ratchet wheel formed on a side of said gear, and a ratchet provided on a front end of said discharge lever and engaging said notched ratchet wheel.

10. A slot machine as claimed in claim 7, wherein each said index notched disk is formed with a plurality of notches therein including notches having bottom walls, and notches without bottom walls permitting entry therethrough of detecting projections provided in said detecting means.

11. A slot machine as claimed in claim 10, wherein each said index notched disk is further formed with semi-open notches therein having bottom walls formed on a side of said index notched disk proximate said drum, said semi-open notches having openings formed through said bottom walls thereof remote from said drum.

12. A slot machine as claimed in claim 10, wherein said coin discharge mechanisms comprises;

a stopper drum fixed for rotation on a control shaft under said main shaft;

a plurality of stopper projections arranged on said stopper drum at axial intervals therealong, said stopper projections being further arranged at differing angular phases with one another around said stopper drum;

a plurality of notched members suspended above said stopper drum and carried on said main shaft, said notched members being engageable with said stopper projections on said stopper drum; and a plurality of operating lever means carried on said main shaft and being operable for disengaging said notched member from said stopper projections upon entry of corresponding detecting projections of said detecting means into open-bottom notches of said index notched disks, disengagement of different ones of said notched members from said stopper projections determining the angular rotation of said control shaft.

13. A slot machine as claimed in claim 7, wherein said kicker energizing means comprises:

an arm frame coupled to a boss end of said actuating lever means, said hook means being mounted on a front end of said arm frame, said arm frame being rotatable on said main frame and engaging said hook with said actuating frame when said actuating lever means is pulled forward partially, and disengaging said hook means from said actuating frame when said actuating lever means is pulled forward completely; and wherein said kicker means is rotatably carried on said main shaft and in a rear portion of said actuating frame, said kicker means being rotatable with said actuating frame for engaging said index notched disks when said actuating lever means is pulled forward, said kicker means being quickly returnable to an original position thereof for causing said drums to be rotated in unison upon disengagement of said hook means from said actuating frame.

14. A slot machine as claimed in claim 7, wherein said detecting means includes;

a first projection engaging notches of a first one of said index notched disks;

a second projection engaging notches of a second one of said index notched disks;

a third projection engaging notches of said second index notched disk which notches are proximate the side of said drum on which said second index notched disk is incorporated;

a fourth projection engaging notches of a third one of said index notched disks which notches are engaged thereby on a far side of said third index notched disk from the side of the drum in which said third index notched disk is incorporated;

a fifth projection engaging notches of said third index notched disk, said fifth projection engaging said notches on a near side thereof proximate said drum side on which said third index notched disk is incorporated; and wherein some notches of each said index notched disks are formed without bottom walls, and entry of said third, fourth and fifth projections into notches without bottom walls provides detection of one or more hit modes.

15. A slot machine as claimed in claim 7, wherein said coin discharge mechanisms comprises;

a stopper drum fixed for rotation on a control shaft under said main shaft;

a plurality of stopper projections arranged on said stopper drum at axial intervals therealong, said stopper projections being further arranged at differing angular phases with one another around said stopper drum;

a plurality of notched members suspended above said stopper drum and carried on said main shaft, said notched members being engageable with said stopper projections on said stopper drum; and a plurality of operating lever means carried on said main shaft and being operable for disengaging said notched member from said stopper projections upon entry of corresponding detecting projections of said detecting means into open-bottomed notches of said index notched disks, disengagement of different ones of said notched members from said stopper projections determining the angular rotation of said control shaft.

16. A slot machine as claimed in claim 7, wherein said coin discharge mechanism includes:

first and second sector gears rotatably carried on said main shaft and rotating in the same direction as said actuating lever means when said actuating lever means is pulled forward;

a spring urging said first and second sector gears to return to respective original positions thereof after releasing of said actuating lever means;

a pinion gear fixed on an end of a control shaft provided under said main shaft, said pinion gear meshing with said first sector gear;

a Geneva gear mounted for rotation under said coin bank; and a gear train arranged between said pinion gear and said Geneva gear for driving said Geneva gear to rotate;

whereby rotation of said Geneva gear by one pitch thereof discharges a predetermined number of coins from said coin bank.

* * * * *